US011545026B2

(12) United States Patent
Dorobkowski

(10) Patent No.: US 11,545,026 B2
(45) Date of Patent: Jan. 3, 2023

(54) AUDIO RISER ACTIVE ELECTRICAL SUPERVISION

(71) Applicant: Carrier Corporation, Palm Beach Gardens, FL (US)

(72) Inventor: Barry Dorobkowski, Bradenton, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/540,429

(22) Filed: Dec. 2, 2021

(65) Prior Publication Data

US 2022/0092967 A1 Mar. 24, 2022

Related U.S. Application Data

(62) Division of application No. 16/497,482, filed as application No. PCT/US2018/025802 on Apr. 3, 2018, now Pat. No. 11,263,895.

(Continued)

(51) Int. Cl.

| | |
|---|---|
| ***G08B 29/06*** | (2006.01) |
| ***G08B 29/10*** | (2006.01) |
| *G08B 29/02* | (2006.01) |

(52) U.S. Cl.

CPC ..... *G08B 29/06* (2013.01); *G08B 29/10* (2013.01); *G08B 29/02* (2013.01)

(58) Field of Classification Search

CPC ..... G01R 31/52; G01R 31/50; G01R 31/55; H04R 29/00; H04R 29/001; H04R 29/007; G08B 29/02; G08B 29/00; G08B 29/06

See application file for complete search history.

(56) References Cited

U.S. PATENT DOCUMENTS

| | | | |
|---|---|---|---|
| 3,860,757 | A | 1/1975 | Stewart |
| 3,912,883 | A | 10/1975 | Goodyear |

(Continued)

FOREIGN PATENT DOCUMENTS

| | | | |
|---|---|---|---|
| DE | 102010047220 | A1 | 4/2012 |
| EP | 2017803 | A1 | 1/2009 |

(Continued)

OTHER PUBLICATIONS

International Search Report and Written Opinion for PCT/US2018/025802; Application Filing Date Apr. 3, 2018; dated Jun. 20, 2018 (15 pages).

*Primary Examiner* — Benyam Haile

(74) *Attorney, Agent, or Firm* — Cantor Colburn LLP

(57) ABSTRACT

An audio riser active electrical supervision system includes a high-voltage audio alert system connected to a riser circuit. The high-voltage audio alert system disconnects a high-voltage analog signal from the riser circuit when the audio riser active electrical supervision system operates in a standby mode, and connects the high-voltage analog signal to the riser circuit when the audio riser active electrical supervision system operates in an active alert mode. A plurality of isolator modules operate in a closed state that connects a circuit node to the riser circuit and an open state that disconnects the respective circuit node from the riser circuit. A riser supervision circuit is connected to at least one isolator module to detect a circuit fault on the riser circuit when the audio riser active electrical supervision system operates in the standby mode and the active alert mode.

6 Claims, 5 Drawing Sheets

Related U.S. Application Data

(60) Provisional application No. 62/481,929, filed on Apr. 5, 2017.

(56) References Cited

U.S. PATENT DOCUMENTS

| | | | |
|---|---|---|---|
| 3,989,908 | A | 11/1976 | Budrys |
| 4,258,332 | A | 3/1981 | West |
| 4,698,619 | A | 10/1987 | Loeb |
| 5,097,259 | A | 3/1992 | Testa et al. |
| 5,883,573 | A | 3/1999 | Mazeiko, Jr. |
| 6,611,204 | B2 | 8/2003 | Schmurr |
| 6,958,699 | B1 | 10/2005 | Karam |
| 7,239,218 | B2 | 7/2007 | Nakamura |
| 7,570,672 | B2 | 8/2009 | Farley |
| 7,990,261 | B2 | 8/2011 | Leach |
| 8,280,070 | B2 | 10/2012 | Lontka |
| 8,456,315 | B2 | 6/2013 | Kriz |
| 8,457,330 | B2 | 6/2013 | Curran |
| 9,322,841 | B2 | 4/2016 | Kurz |
| 9,398,388 | B2 | 7/2016 | Botti |
| 2007/0085694 | A1 | 4/2007 | Larkin |
| 2007/0098190 | A1* | 5/2007 | Song ..... H03F 3/2175 330/297 |
| 2013/0148245 | A1 | 6/2013 | Becker et al. |
| 2016/0192101 | A1 | 6/2016 | Park |
| 2016/0247386 | A1 | 8/2016 | Kim et al. |
| 2016/0343242 | A1 | 11/2016 | Warren |
| 2021/0110703 | A1 | 4/2021 | Dorobkowski |

FOREIGN PATENT DOCUMENTS

| | | | |
|---|---|---|---|
| EP | 2229006 | A1 | 9/2010 |
| EP | 2833333 | A1 | 2/2015 |
| WO | 0106808 | A2 | 1/2001 |
| WO | 2009049949 | A1 | 4/2009 |

* cited by examiner

AUDIO RISER ACTIVE ELECTRICAL SUPERVISION

CROSS-REFERENCE

This application is a divisional of U.S. application Ser. No. 16/497,482, filed Apr. 3, 2018, which is a National Stage of International Application No. PCT/US2018/025802, filed Apr. 3, 2018, which claims the benefit of U.S. Provisional Application No. 62/481,929, filed Apr. 5, 2017, the disclosures of which are incorporated by reference herein in their entirety.

TECHNICAL FIELD

The disclosure relates generally to electronic emergency alarm systems, and more particularly, to fire alarm systems.

BACKGROUND

Emergency alarm systems such as fire alarm systems, for example, include various notification and input devices, which are powered through the use of input device circuits (IDCs) and notification appliance circuits (NACs). These circuits are typically installed in several individual zones, each of which contains one or more input and/or notification devices. The input devices include, for example, smoke detectors, and the notification devices include, for example, sirens and strobe lights. The IDCs and NACs are typically connected to a common riser or audio bus via a respective circuit node. The circuit nodes are typically connected to one another in series or in a daisy-chain configuration. When an alarm event is detected, an audio signal is typically generated, amplified, and output to the audio riser such that the audio alert is output via the notification devices. Due to this series configuration of the IDCs and NACs, however, a fault in any given zone or device will affect all other zones or devices in the circuit.

SUMMARY

According to a non-limiting embodiment, an audio riser active electrical supervision system comprises a riser circuit in signal communication with a plurality of notification devices via a respective circuit node. Each circuit node is located remotely from one another. A high-voltage audio alert system is in signal communication with an input of the riser circuit. The high-voltage audio alert system is configured to disconnect a high-voltage analog signal from the riser circuit when the audio riser active electrical supervision system operates in a standby mode and to connect the high-voltage analog signal to the riser circuit when the audio riser active electrical supervision system operates in an active alert mode. One or more isolator modules are in signal communication with at least one output of the riser circuit. Each isolator module is configured to operate in a closed state that connects the respective circuit node to the at least one output of the riser circuit and an open state that disconnects the respective circuit node from the at least one output of the riser circuit. The audio riser active electrical supervision system further includes at least one riser supervision circuit in signal communication with at least one isolator module. The riser supervision circuit is configured to detect a circuit fault on the riser circuit when the audio riser active electrical supervision system operates in the standby mode and the active alert mode.

The audio riser active electrical supervision system includes another feature, wherein an activated isolator module among the at least one isolator module invokes the open state in response to a DC voltage signal generated by the at least one riser supervision circuit indicative of the circuit fault.

The audio riser active electrical supervision system includes another feature, wherein remaining circuit nodes located downstream from the activated isolator module remain connected to riser circuit while a faulty circuit node located upstream from the activated isolator module is disconnected from the riser circuit such that the circuit fault is isolated from the remaining circuit nodes.

The audio riser active electrical supervision system includes another feature, wherein the at least one output of the riser circuit includes a first riser output and a second riser output, the first and second riser outputs connected to each of the circuit nodes.

The audio riser active electrical supervision system includes another feature, wherein each isolator module comprises a relay switch including a first circuit path that connects the respective circuit node to the at least one riser output and a second circuit path that disconnect the respective circuit node from the at least one riser output, and a coil in signal communication with the at least one riser supervision circuit, wherein a voltage level applied to the coil selects one of the first circuit path and the second circuit path.

The audio riser active electrical supervision system includes another feature, wherein the at least one riser supervision circuit outputs a first direct current (DC) voltage signal to the coil when the circuit fault is not detected and outputs a second DC voltage signal different from the first DC voltage signal when the circuit fault is detected.

The audio riser active electrical supervision system includes another feature, wherein the relay switch selects the first circuit path in response to receiving the first DC voltage signal and selects the second circuit path in response to receiving the second DC voltage signal so as to isolate the circuit fault.

The audio riser active electrical supervision system includes another feature, wherein the at least one riser supervision circuit comprises a DC voltage supply that applies a DC voltage to the riser circuit, an AC coupling device connected between the input of the riser circuit and the DC voltage supply, and wherein the AC coupling device combines the DC voltage and the high-voltage analog signal in response to invoking the active alert mode.

The audio riser active electrical supervision system includes another feature, wherein the at least one riser supervision circuit further comprises a low pass filter connected between the DC voltage supply and a respective circuit node, the low pass filter configured to block the high-voltage analog signal from passing therethrough while passing the DC voltage signal to the isolator module connected to the respective circuit node.

According to another non-limiting embodiment, a riser supervision circuit is installed in a riser circuit of an audio riser active electrical supervision system. The riser supervision circuit comprises a direct current (DC) voltage supply configured to apply a DC voltage to the riser circuit, and an AC coupling device electrically connected to the riser circuit between an analog input of the riser circuit and the DC voltage supply. The AC coupling device is configured to superimpose the DC voltage with a high-voltage analog signal applied to the riser circuit. The riser supervision circuit further includes a low pass filter having an input connected to the riser circuit, and an output connected to a fault detection circuit path that is separated from the riser circuit. The low pass filter extracts the DC voltage supply from the riser circuit and outputs the DC voltage to the fault detection circuit path while blocking analog audio signals from the fault detection circuit path.

The riser supervision circuit includes another, wherein the DC voltage supply includes a positive voltage terminal connected to a positive riser input of the analog input, and a negative voltage terminal connected to a negative riser input of the analog input.

The riser supervision circuit includes another feature, wherein the AC coupling device includes at least one capacitor including a first terminal connected to the negative riser input and an opposite terminal connected to the negative voltage terminal of the DC voltage supply.

The riser supervision circuit includes another feature, wherein the low pass filter includes a first filter input connected the positive riser input downstream from the positive voltage terminal of the DC voltage supply, a second filter input connected to the negative riser input downstream from the negative voltage input, and a filter output connected to the fault detection circuit path.

According to yet another non-limiting embodiment, a method of monitoring a riser circuit included in an audio riser active electrical supervision system comprises applying a direct current (DC) voltage signal to the riser circuit and, in response to detecting an alarm event, applying a high-voltage analog audio signal to the riser circuit that is delivered to at least one circuit node connected to the riser circuit. The method further includes superimposing the high-voltage analog audio signal to the riser circuit with the DC voltage signal. The method further includes filtering the DC voltage signal from the high-voltage analog audio signal, and outputting the filter DC voltage signal to a fault detection circuit path isolated from the riser circuit while the high-voltage analog audio signal is maintained on the riser circuit. The method further includes detecting a circuit fault on the riser circuit based on a voltage level of the filtered DC voltage signal applied to the fault detection circuit path.

The method includes another feature, wherein in response to detecting the circuit fault, disconnecting, from the riser circuit, a circuit node affected by the circuit fault to isolate the circuit fault from remaining circuit nodes located downstream from the disconnected circuit node.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
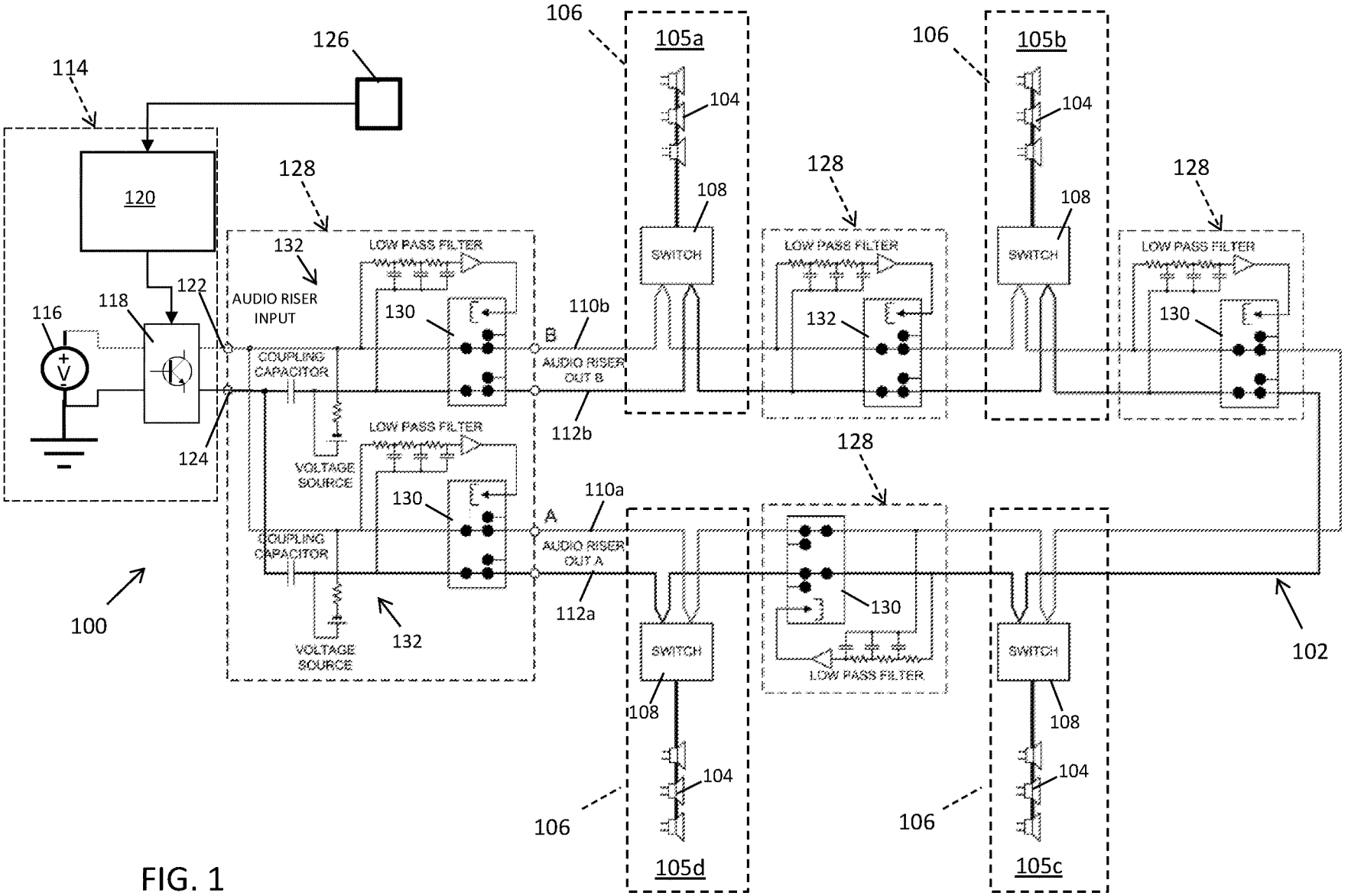
FIG. 1 is a block diagram of an audio riser active electrical supervision system including an audio riser active electrical supervision circuit according to a non-limiting embodiment.

Building codes and emergency regulations may require that a fault in one zone does not affect the operation of other zones. For instance, the Canadian ULC5247-14 requirement has been updated to require that any fault occurring in one zone does not impact the performance on any other zone. In addition, the Canadian requirement specifies that the audio circuit be isolated within one second of the detection of a circuit fault such as, for example, a short circuit and/or an open circuit.

Isolator circuits, also referred to as line isolators, have been developed in order to isolate faults in any given zone. These line isolators are typically connected in a series configuration such that each line isolator is connected in series with each zone. If a short circuit fault, such as a wire-to-wire short, is detected in a particular zone, the line isolators on the affected zone are electrically opened, thereby isolating the zone from the rest of the circuit. Power is then supplied on a return path of the riser in order to continue to power the devices in the zones which are further down the line from the newly opened isolator.

Existing isolation circuits employed in 25V and 70V audio systems function only when the alarm systems exists in standby mode, i.e., when no alert is detected. In standby mode, the amplifier is disconnected from the riser and instead a DC supervisory voltage is connected to the riser. The DC voltage is measured to determine whether the riser is shorted. Unfortunately, if a short circuit is detected on the audio riser in standby, the audio will not turn on if an alarm occurs. This of course affects all zones connected to the riser.

To meet regulatory standards such as, for example, Canadian fire alert and emergency system standards that require the audio circuit must be isolated within one second of the detection of a short circuit, it is necessary to monitor the riser during both a standby mode (i.e., when no emergency alert is detected) and an active mode (i.e., when an emergency alert is detected). However, applying a DC supervision voltage while the audio riser is active is impractical with respect to conventional alarm systems because the DC impedance of the amplifier output transformer is very low (e.g., a couple of Ohms). Also, DC voltage on the riser can cause audio noise (clicks and pops), affecting intelligibility and possibly causing damage to the audio system. Applying and monitoring an out of band signal on the audio riser has been considered in the past, but this technique is also impractical because the frequency of the signal must be considerably higher than the bandwidth of the audio system (about 400 Hz to about 4 KHz; +/−3 dB) and must be inaudible. A high frequency signal is prone to loading by riser capacitance and will likely cause harmonic distortion of the audio signal.

At least one non-limiting embodiment described herein provides an audio riser active electrical supervision system capable of monitoring high-voltage (e.g., 25V and 70V) audio riser circuits to detect circuit faults (e.g., short circuit, open circuits, etc.) when the alarm system operates in either a standby mode or an active mode. For instance, the audio riser active electrical supervision system conducts DC supervision of a high-voltage audio riser circuit independent of the presence of an audio signal applied during an active mode of the system. The audio riser active electrical supervision system includes an audio amplifier and one or more speakers. The audio amplifier and the speakers are each coupled to the audio riser by a respective capacitor circuit. Because the speakers are also AC coupled to the riser circuit, a DC supervision voltage can be monitored independently with respect to an active high-voltage audio signal. Accordingly, circuit faults such as short circuits, for example, can be monitored during both a standby mode and an active alarm mode thereby satisfying required alarm system regulations.

Turning now to FIG. 1, an audio riser active electrical supervision system 100 is illustrated according to a non-limiting embodiment. The system 100 includes an audio riser circuit 102 (hereinafter referred to an audio riser 102) and a plurality of notification devices 104 such as one or more audio speakers or sirens, for example, installed in a respective zone 105*a*, 105*b*, 105*c* and 105*d*. The notification devices 104 are connected to the riser 102 via a respective switch 108, which is controlled by a fire panel (not shown) to turn on the notification devices 104 in a particular zone. The collection of notification devices 104 and switches 108 at a given zone 105*a*-105*d* essentially (but non-exclusively) defines a circuit node 106 of the riser 102.

The riser 102 includes a first set of output terminals (A) and a second set of output terminals (B). The first set of output terminals (A) includes a first positive output 110*a* and a first negative output 112*a*, while the second set of output terminals (B) includes a second positive output 110*b* and a second negative output 112*b*. Each switch 108 is connected to first and positive outputs 110*a*-110*b* along with the first and second negative outputs 112*a*-112*b*. In at least one embodiment, the switches 108 are constructed as double-pole relay switches which are controlled by the fire panel to turn on or off notification devices 104 in a particular zone 105*a*-105*d*.

The circuit nodes 106 are connected in a daisy-chain arrangement while the two sets of output terminals (A) and (B) are connected as a loop to provide connection redundancy. The daisy-chain configuration allows a faulty circuit node 106 or switch 108 to be disconnected from the riser 102, while remaining circuit nodes 106 downstream from the disconnected circuit node remain operational. For instance, if a circuit fault affects a first set of output terminals (e.g., the first positive output 110*a* and the first negative output 112*a*) in one section of the riser 102 or in a particular zone 105*a*, 105*b*, 105*c* and/or 105*d*, the second positive output 110*b* and the second negative output 112*b* can maintain operation of the remaining zones located downstream from the circuit fault.

The audio riser active electrical supervision system 100 further includes a high-voltage audio alert system 114 in signal communication with the riser 102. The high-voltage audio alert system 114 includes an analog voltage power supply 116, an audio amplifier 118, and an electronic hardware alert controller 120. The audio amplifier 118 receives an analog input voltage from the analog voltage supply 114, and generates a high-voltage analog audio signal that is applied to a positive riser input terminal 122 and a negative riser input terminal 124. The high-voltage analog audio signal has an alternating current (AC) voltage of approximately 70 Volts Root Mean Square (RMS ($V_{RMS}$)), for example, or more. Any type of amplifier circuit capable of converting the input analog voltage into the desired high-voltage analog audio signal can be implemented in the high-voltage audio alert system 114.

The alert controller 120 is in signal communication with the audio amplifier 118 and one or more input sensors 126. The sensors 126 include, for example, a smoke detector. The input sensor 126 is configured to output an emergency signal in response to detecting an emergency input. In terms of a smoke detector, for example, the input sensor 126 outputs the emergency signal in response to detecting smoke. The alert controller 120 controls operation of the audio amplifier 118. When no emergency alert signal is received from the input sensor 126, the alert controller 120 deactivates the audio amplifier. Accordingly, a high-voltage audio signal is not applied to the riser 102 such that the riser 102 operates in a standby mode. When, however, the alert controller 120 receives the emergency alert signal from the input sensor 126, the alert controller 120 activates the audio amplifier 118 and the high-voltage audio signal is applied to the positive riser input terminal 122 and a the negative riser input terminal 124. Accordingly, the riser 102 is transitioned into an active mode and the high-voltage audio signal is delivered to the notification devices 104 where the audio alert is output to each respective zone 105*a*-105*d*.

The system 100 further includes one or more isolator modules 128. Each circuit node 106 is connected between a pair of isolator modules 128. The isolator modules 128 are configured to selectively operate in a closed state and an open state. In at least one embodiment, the isolator modules 128 include relay switches 130 configured to operate in the close state and the open state. When operating in the closed state, an electrically conductive path is established which allows electrical signals to pass through the isolator module 128. When operating in the open state, however, the electrically conductive path is disconnected thereby preventing electrical signals from passing through the isolator module 128.

The isolator modules 128 operate in the closed state when the system 100 is operating normally, i.e., when no circuit faults exist in the riser 102. When a circuit fault is detected in a section of the riser 102 or a circuit node 106 which is connected to a respective isolator module 128, the open state of the respective isolator module 128 is invoked and the circuit fault is isolated while the remaining circuit nodes 106 continue operating normally. Accordingly, a circuit fault in a faulty circuit node (e.g., a circuit node 106 connected to zone 105*a*) can be isolated such that the circuit fault does not impact the performance on the remaining circuit nodes (e.g., a circuit node 106 connected to zones 105*b*-105*d*).

Conventional riser systems may include various types of isolators for isolating faults in a particular section of the riser. However, these conventional riser systems are incapable of detecting a fault when the riser system operates in an active alarm mode. That is, conventional riser systems cannot detect a circuit fault on the riser circuit while a high-voltage audio signal is applied to the riser. Unlike conventional riser systems, at least one of the isolator modules 128 included in the audio riser active electrical supervision system 100 implements an audio riser active electrical supervision circuit 132 capable of monitoring the riser 102 for circuit faults while operating in the active alarm mode (i.e., when a high-voltage analog signal is applied to the riser) as described in greater detail below.

Figure 2A:
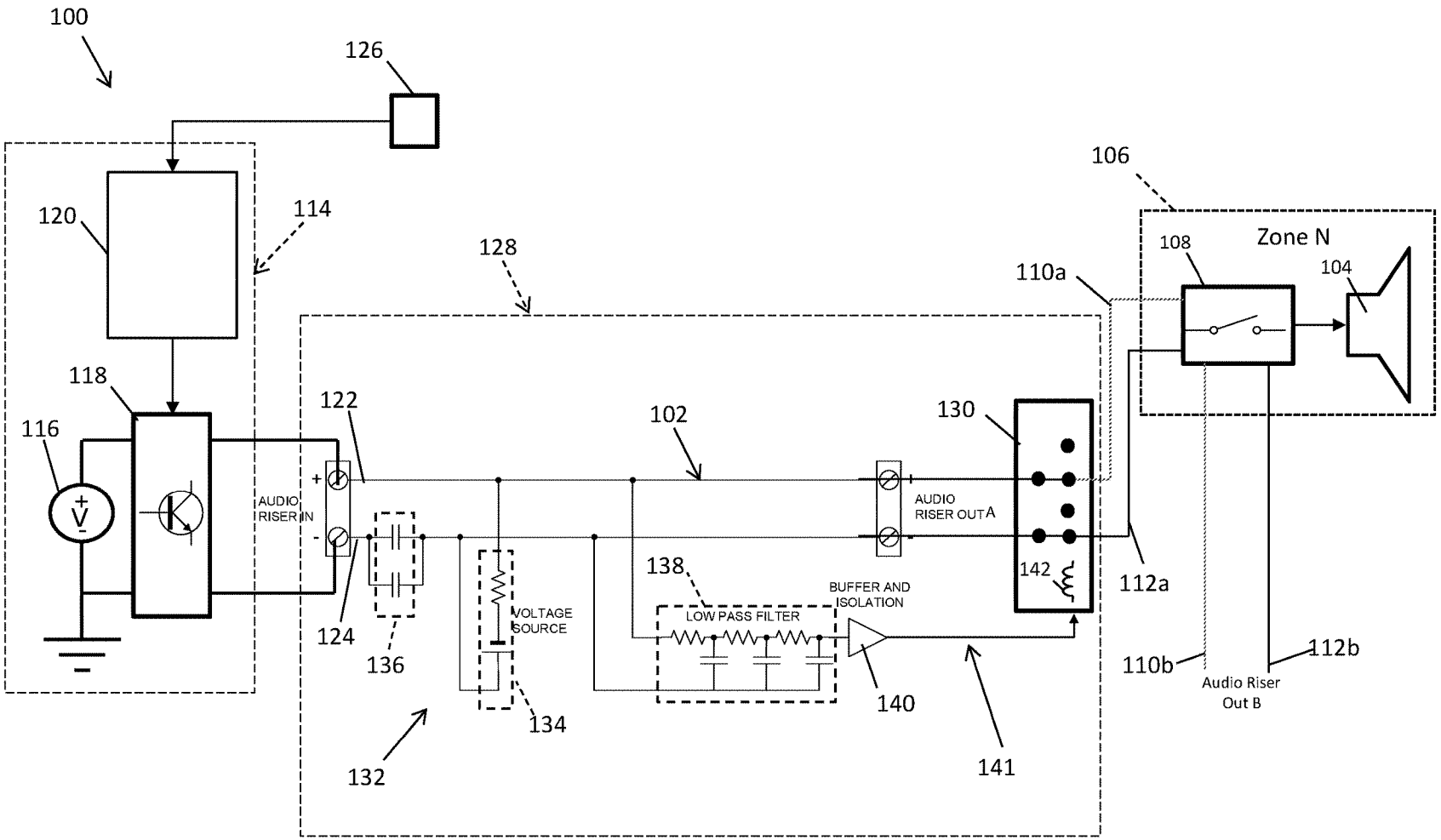
FIG. 2A is a block diagram of an individual audio riser active electrical supervision circuit and an isolation module operating in a closed state.
Figure 2B:
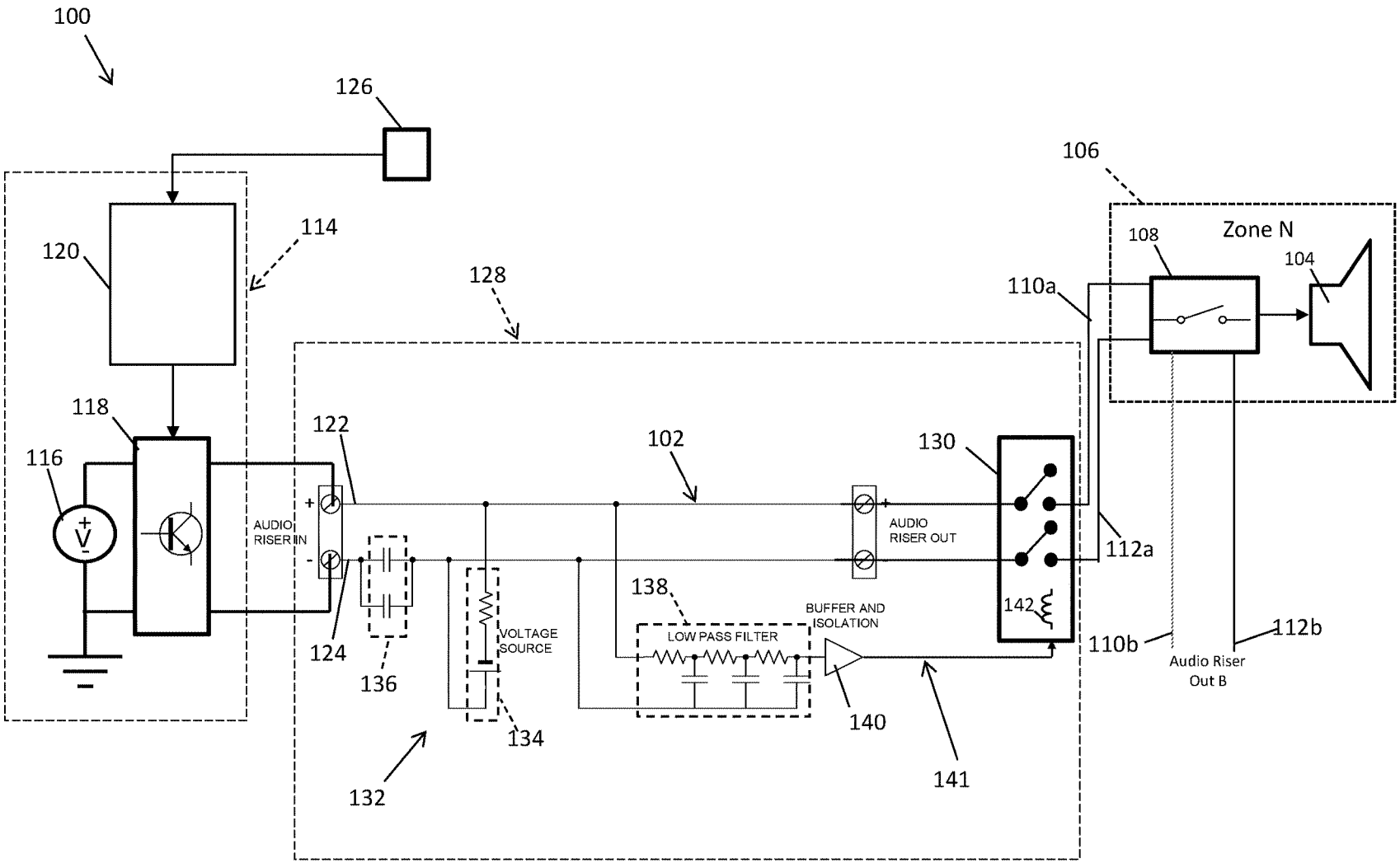
FIG. 2B is a block diagram of an individual audio riser active electrical supervision circuit and an isolation module operating in an open state.

Referring to FIGS. 2A and 2B, an isolator module 128 including an audio riser active electrical supervision circuit 132 (hereinafter referred to as a riser supervision circuit 132) is illustrated according to a non-limiting embodiment. The riser supervision circuit 132 includes a direct current (DC) voltage supply 134, an AC coupling device 136, a low pass filter 138, and a buffer isolation circuit 140.

The DC voltage supply 134 applies a DC voltage across the positive riser input 122 and the negative riser input 124. In at least one embodiment, the DC voltage supply includes a DC voltage source connected in series with a resistor. A ground potential of the DC voltage source is connected to the negative riser input 124 while a positive voltage potential is connected to a first end of the resistor. The opposing end of the resistor is connected to the positive riser input 122.

The AC coupling device 136 is interconnected between the negative riser input 124 and the DC voltage supply 134. Although the AC coupling device 136 is illustrated as including a parallel arrangement of capacitors connected to the negative riser input 124, it should be appreciated that a single capacitor connected between the negative riser input 124 and the DC voltage supply 134 can be employed. When the high-voltage audio signal is applied to the riser 102, the AC coupling device 136 is configured to superimpose the high-voltage audio signal with the DC voltage applied by the DC voltage supply 134.

The low pass filter 138 is connected between the DC voltage supply 134 and the buffer isolation circuit 140. A first input of the low pass filter 138 is connected to the positive riser input 122, a second input of the low pass filter 128 is connected to the negative riser input 124, and an output of the low pass filter is connected to the buffer isolation circuit 140. In at least one embodiment illustrated in FIGS. 2A and 2B, the low pass filter is constructed as a three-stage filter. Each stage includes a filter resistor connected with a capacitor to form an individual low pass filter circuit. Although a three-stage filter is illustrated, it should be appreciated that a single-stage or two-stage filter can be employed. During an active alarm mode, the low pass filter 138 receives the superimposed signal containing both the high-voltage analog signal and the DC voltage signal, and operates to filter (i.e. extract) the DC voltage signal which is then output to a separate fault detection circuit path 141. In this manner, the DC voltage can be monitored independently while the high-voltage analog signal can remain on the riser 102 and be delivered one or more circuit nodes 106.

The buffer isolation circuit 140 includes an input connected to the low pass filter 138 and an output connected to the relay switch 130. The connection of the low pass filter 138 and the buffer isolation circuit 140 effectively provides a separate fault detection circuit path 141 that delivers the DC voltage to the relay switch 130. In this manner, the DC voltage can be monitored via the relay switch to determine whether a circuit fault exists on the riser 102. In at least one embodiment, the buffer isolation circuit 140 can be constructed as a buffer amplifier circuit, and is configured to transfer the voltage output from the low pass filter 138 having an high output impedance, to the relay switch 130 having a low input impedance that is different from the output impedance.

As described herein, the riser supervision circuit 132 is capable of monitoring the DC voltage applied to by DC voltage supply 134 when the system is operating in either the standby mode (i.e., when the high-voltage analog signal is not applied to the riser 102) or the active mode (i.e., when the high-voltage analog signal is applied to the riser 102). When operating in the standby mode, the DC voltage exists alone on the riser 102 and is passed to the relay switch 130 via the low pas filter 138.

To monitor the DC voltage when operating in the active mode, the low pass filter 138 blocks the high-voltage audio signal from reaching the buffer isolation circuit 140 while still passing the DC voltage. The DC voltage can then be recovered and monitored at the output of the buffer isolation circuit 140. When the riser circuit operates normally without a circuit fault, the DC voltage is passed through low pass filter 138 and energizes a coil 142 included in the relay switch 130. The energized coil 142 forces the relay switch 130 into the closed state, thereby creating an electrically conductive path that allows the high-voltage analog signal to reach the notification devices 104 (e.g., speaker) of the corresponding circuit node 106 (see FIG. 2A). If a short circuit, for example, occurs on the riser 102 at any time, including while the system 100 operates in the active mode, the DC voltage applied to the riser 102 will fall thereby de-energizing the relay coil 142 and invoking the open state of the relay switch 130 (see FIG. 2B) thereby disconnecting the corresponding circuit node 106 from the riser 102. In this manner, the isolation module 128 can isolate a short circuit on a faulty set of output terminals (e.g., the first set of output terminals A) regardless as to whether the system operates in the standby mode or the active alarm mode, while the remaining circuit nodes 106 can still operate normally due to the electrical redundancy provided by the functioning set of output terminals (e.g., the second set of output terminals B).

Figure 3A:
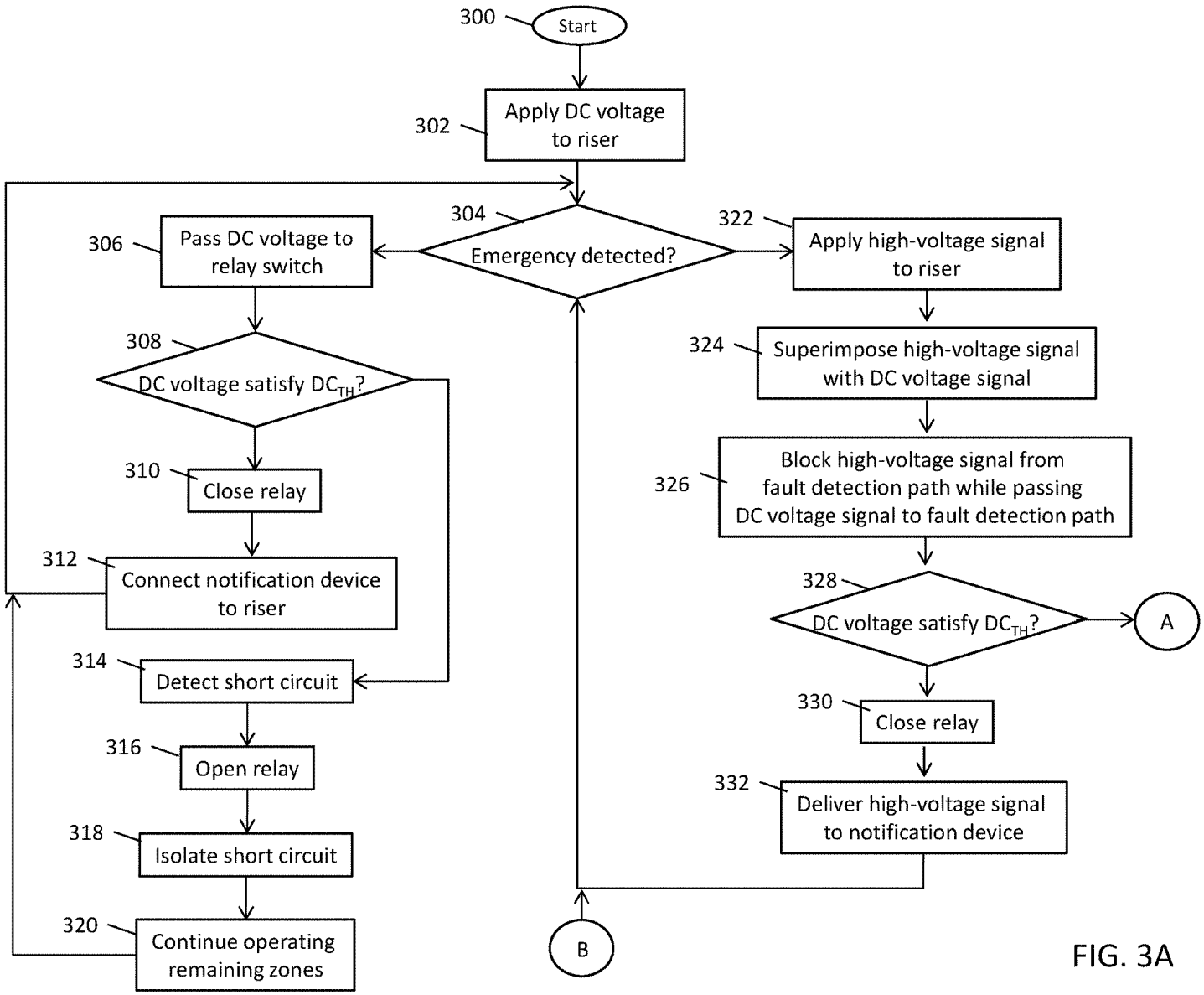
FIGS. 3A and 3B illustrate a method of isolating a circuit fault in an audio riser active electrical supervision system according to a non-limiting embodiment.
Figure 3B:
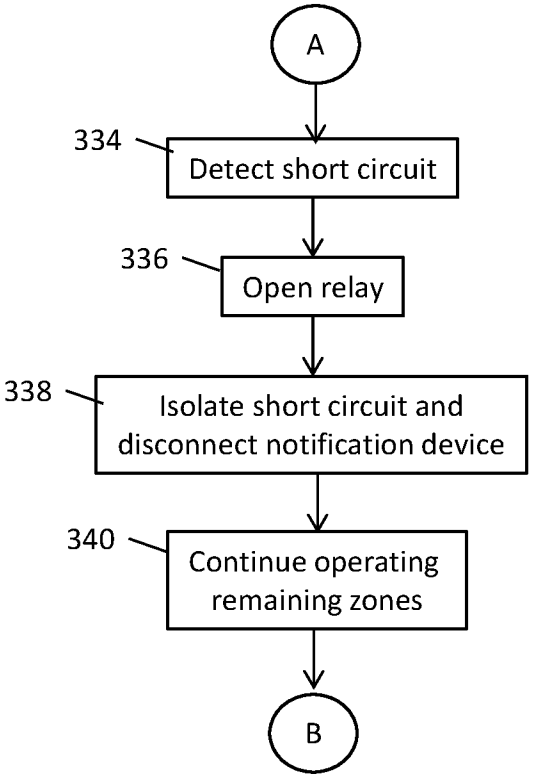

Turning now to FIGS. 3A and 3B, a method of isolating a circuit fault in an audio riser active electrical supervision system is illustrated according to a non-limiting embodiment. The method begins at operation 300, and at operation 302 a DC voltage signal is applied to a riser included in the audio riser active electrical supervision system. At operation 304, a determination is made as to whether an emergency condition is detected via an input sensor such as, for example, a smoke detector. When no emergency condition is detected, the method proceeds to operation 306 and the DC voltage signal is passed through a low pass filter to a fault detection circuit path and is delivered to a relay switch. When the DC voltage signal satisfies a threshold voltage level ($DC_{TH}$) necessary to energize a coil of the relay switch at operation 308, the relay switch is forced into a closed state at operation 310. Accordingly, a notification device such as a speaker, for example, installed at a respective zone of the system is connected to the riser at operation 312, and the method returns to operation 304. When, however, the DC voltage signal is below $DC_{TH}$ at operation 308, a short circuit is detected at operation 314 and the coil of the relay switch is de-energized at operation such that the relay switch is forced into an open state at operation 316. In this manner, the short circuit is isolated at the respective zone and notification device is disconnected from the riser at operation 318. The remaining notification devices continue operating as normal at operation 320, and the method returns to operation 304.

When an emergency condition is detected at operation 304 during any stage of operation, the method proceeds to operation 322 and a high-voltage analog signal is applied to the riser. The high-voltage analog signal includes, for example, an analog audio signal having a voltage level of approximately 70 $V_{RMS}$. At operation 324, the high-voltage analog signal is superimposed (i.e., combined) with the DC voltage signal applied to the riser. An AC coupling device such as a parallel arrangement of capacitors coupled to the riser, for example, can be used to superimpose the high-voltage analog signal with the DC voltage signal.

At operation 326, a low pass filter blocks the high-voltage analog signal from reaching the fault detection circuit path, while passing the DC voltage signal to the fault detection circuit path. When the DC voltage signal satisfies $DC_{TH}$, at operation 328, the relay switch is forced into a closed state at operation 330. Accordingly, the high-voltage analog signal is delivered to the notification device, e.g., a speaker, installed at the respective zone of the system at operation 332, and the method returns to operation 304. When, however, the DC voltage is below $DC_{TH}$ at operation 328, a short circuit is detected at operation 334 and the relay coil is de-energized such that the relay switch is forced into an open state at operation 336. Accordingly, the short circuit is isolated at the respective zone and the notification device is disconnected from the riser at operation 338. The remaining notification devices continue operating as normal at operation 340, and the method returns to operation 304.

As described herein, various non-limiting embodiments provide an audio riser active electrical supervision system capable of monitoring high-voltage (e.g., 25V and 70V) audio riser circuits to detect circuit faults (e.g. short circuits, open circuits, etc.) when the alarm system operates in either a standby mode or an active mode. An audio riser active electrical supervision circuit included in the system superimposes a high-voltage analog audio signal with a DC supervision voltage applied to the riser. A low pass filter passes the DC supervision voltage to a separate path while the high-voltage analog audio signal is maintained on riser and is delivered to all zones of riser when the riser is operating normally. The separate path is independently monitored to determine if DC supervision voltage indicates the occurrence of a current fault (e.g., short circuit, open circuit, etc.) on the riser. Accordingly, the an audio riser active electrical supervision system is capable of monitoring the riser for circuit faults when operating in both a standby mode and an active alarm mode thereby satisfying required alarm system regulations. The daisy-chain configuration of the circuit nodes 106 allows a faulty circuit node to be disconnected from the riser, while remaining circuit nodes downstream from the disconnected circuit node remain operational. When a circuit fault is detected while operating in either mode, the circuit fault (e.g., circuit node experiencing a short circuit) can be isolated such that the circuit fault does not impact the performance on the remaining circuit nodes located downstream from the circuit fault.

As used herein, the term "module" refers to an application specific integrated circuit (ASIC), an electronic circuit, an electronic computer processor (shared, dedicated, or group) and memory that executes one or more software or firmware programs, a combinational logic circuit, and/or other suitable components that provide the described functionality. When implemented in software, a module can be embodied in memory as a non-transitory machine-readable storage medium readable by a processing circuit and storing instructions for execution by the processing circuit for performing a method.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A riser supervision circuit installed in a riser circuit of an audio riser active electrical supervision system, the riser supervision circuit comprising:

a direct current (DC) voltage supply configured to apply a DC voltage to the riser circuit;

an AC coupling device electrically connected to the riser circuit between an analog input of the riser circuit and the DC voltage supply, the AC coupling device configured to superimpose the DC voltage with a high-voltage analog signal applied to the analog input; and a low pass filter including an input connected to the riser circuit and an output connected to a fault detection circuit path that is separated from the riser circuit, wherein the low pass filter extracts the DC voltage supply from the riser circuit and outputs the DC voltage to the fault detection circuit path while blocking analog audio signals from the fault detection circuit path.

2. The riser supervision circuit of claim 1, wherein the DC voltage supply includes a positive voltage terminal connected to a positive riser input of the analog input, and a negative voltage terminal connected to a negative riser input of the analog input.

3. The riser supervision circuit of claim 2, wherein the AC coupling device includes at least one capacitor including a first terminal connected to the negative riser input and an opposite terminal connected to the negative voltage terminal of the DC voltage supply.

4. The riser supervision circuit of claim 3, wherein the low pass filter includes a first filter input connected the positive riser input downstream from the positive voltage terminal of the DC voltage supply and a second filter input connected to the negative riser input downstream from the negative voltage input, and a filter output connected to the fault detection circuit path.

5. A method of monitoring a riser circuit included in an audio riser active electrical supervision system, the method comprising:

applying a direct current (DC) voltage signal to the riser circuit;

in response to detecting an alarm event, applying a high-voltage analog audio signal to the riser circuit that is delivered to at least one circuit node connected to the riser circuit;

superimposing the high-voltage analog audio signal to the riser circuit with the DC voltage signal;

filtering the DC voltage signal from the high-voltage analog audio signal, and outputting the filter DC voltage signal to a fault detection circuit path isolated from the riser circuit, while the high-voltage analog audio signal is maintained on the riser circuit; and detecting a circuit fault on the riser circuit based on a voltage level of the filtered DC voltage signal applied to the fault detection circuit path.

6. The method of claim 5, wherein in response to detecting the circuit fault, disconnecting, from the riser circuit, a circuit node affected by the circuit fault to isolate the circuit fault from remaining circuit nodes located downstream from the disconnected circuit node.

* * * * *